United States Patent [19]

Huydts

[11] 4,377,942

[45] Mar. 29, 1983

[54] METHOD OF BENDING METAL SHEET

[75] Inventor: Eduard J. C. Huydts, Düsseldorf-Gerresheim, Fed. Rep. of Germany

[73] Assignee: G. Siempelkamp GmbH & Co., Krefeld, Fed. Rep. of Germany

[21] Appl. No.: 261,646

[22] Filed: May 7, 1981

[30] Foreign Application Priority Data

May 9, 1980 [DE] Fed. Rep. of Germany ..... 3017758

[51] Int. Cl.[3] ..... B21D 5/01

[52] U.S. Cl. ..... 72/389; 72/368; 72/412

[58] Field of Search ..... 72/385, 389, 386, 380, 72/412, 367, 368, 470

[56] References Cited

U.S. PATENT DOCUMENTS

| | | | |
|---|---|---|---|
| 1,879,078 | 9/1932 | Carlsen | 72/368 |
| 3,146,819 | 9/1964 | Van Endert | 72/389 |
| 3,705,512 | 12/1972 | Koschatzky | 72/389 |
| 3,978,706 | 9/1976 | Nakagawa | 72/389 |
| 4,294,095 | 10/1981 | Kawano | 72/368 |

*Primary Examiner*—Gene Crosby

*Attorney, Agent, or Firm*—Karl F. Ross; Herbert Dubno

[57] ABSTRACT

A method of and apparatus for the bending of metal-sheet section comprises a bending saddle engaging the section at two spaced-apart points and a bending anvil or support engaging the workpiece at two other points disposed outwardly of the first two points. The bending saddle is pressed toward the anvil so that the sheet bends substantially uniformly between the two bearing points of the saddle and the two support points of the anvil with substantially equal bending force components equidistant from the center between the support points. After each bending stroke of the saddle, the workpiece is advanced by an increment less than the length of the uniformly bent section between the two saddle bearing points.

4 Claims, 7 Drawing Figures

METHOD OF BENDING METAL SHEET

FIELD OF THE INVENTION

My present invention relates to the bending of metal and, more particularly, to a method bending metal sheet, metal plates and like workpieces into approximately round shapes.

BACKGROUND OF THE INVENTION

It is frequently necessary to bend (i.e. plastically deform) relatively large metal workpieces, e.g. metal plates or sheets, utilizing a bending press into round configurations, i.e. configurations conforming approximately to that of a circle segment, e.g. a semicylinder.

Various bending dies are customarily provided for this purpose and the bending press may be capable of operating with such dies utilizing extremely high pressures generated, for example, hydraulically.

When large-diameter workpieces of circular segmental configuration are to be fabricated from steel plate or sheet, for example, the bending may be carried out stepwise by bending the workpiece in sections between two fixed spaced-apart supports on a bending anvil which can constitute the fixed member of the bending die.

The other member of the bending die is generally a ram which has a bearing line lying centrally between the bearing lines along which the workpiece is supported.

The bending ram is vertically displaceable and, during its downstroke, performs the bending action by depressing the workpiece between the two supports. The workpiece is then advanced transversely to the bearing lines upon retraction of the ram which, upon a subsequent descent, bends another section of the workpiece so that ultimately an approximately round curvature is imparted thereto.

Workpieces can be bent in this manner to form, for example, trough-shaped and even semicylindrical bodies which can be welded together to form large-diameter pipes, containers, tanks and the like.

The bending ram of prior art systems generally has a semicylindrical configuration, i.e. a semicircular cross-section, so that it engages with more or less point contact (as seen in cross-section) the workpiece in the geometric center between the two support points of the anvil.

As a result of this relationship, the bending action tends to progress outwardly from the contact point or line of the ram and to alter as the workpiece contacts more of the rounded lower end of the latter or as the bending causes the metal workpiece to roll along the surface of this end during the bending operation.

Experience has shown that this results in a continuous change in the curvature to either side of the central point of attack and thus in a bent section whose curvature is highly non-uniform. The greatest radius of curvature lies directly beneath the ram while the radius of curvature decreases to either side thereof so that, with reciprocation of the ram and advance of the workpiece in the manner described, a multiplicity of nonuniform curvatures can be imparted to the workpiece.

It is thus difficult, if not impossible, to obtain an approximately circular curvature within narrow tolerances as may be required for the fabrication of pipes, tanks or the like by welding such workpieces together.

Even when efforts are made to overcome this problem by reducing the feed increment of the workpiece to a minimum, the problem is not fully resolved and, of course, the reduction in the increment of advance of the workpiece during each stroke of the ram results in an extremely costly and time consuming process.

OBJECTS OF THE INVENTION

It is, therefore, the principal object of the present invention to provide a method of bending flat metal workpieces, especially metal sheet and metal plate, whereby the disadvantages of prior art methods are avoided and a highly uniform and reproducible bend can be imparted to a workpiece which can closely approximate a circular or cylindrical curvature within narrow tolerances.

Another object of the invention is to provide a bending method for the production of uniformly curved bent metal plate or sheet workpieces which can be operated with comparatively large increments of displacement of a workpiece when the bending is carried out in a succession of bending operations with incremental advance of the workpiece.

Still another object of the invention is to provide a method of bending a workpiece of the type described which is rapid and involves low labor costs.

It is another object of the invention to provide an improved method of bending metal workpieces which is particularly suitable for the production of semicylindrical trough-shaped products adapted to be welded together to form tanks, containers, pipes or the like.

SUMMARY OF THE INVENTION

These objects and others which will become apparent hereinafter are attained, in accordance with the present invention, in a method of bending flat metal workpieces, e.g. metal sheet or metal plate, preferably of steel, which comprises supporting the workpiece at two locations (support locations) upon a bending anvil, the two locations being spaced apart and being spanned by a section of the workpiece to be bent, and applying force to the thus-supported workpiece at two spaced-apart locations (bearing locations) by a bending saddle or ram, the latter bearing locations being spaced apart on opposite sides of the center of this section so that two bending force components are applied to each section to be bent which are equidistant from the center between both support locations, the bending sections being advanced incrementally by a distance which is smaller than the length of the bending section, i.e. than the distance between the two support locations.

Preferably, the bending force components are applied at the bearing locations which are disposed at respective distances from the support location which are equal to between substantially a tenth and a quarter of the length of the bending section (distance between support locations).

It has been found that this relationship ensures that, in the region between the bearing locations, the bending moment applied to the workpiece is substantially constant so that a completely uniform bend is generated in this region which can correspond to the length of the increment of advance of the workpiece when the bending saddle is retracted.

The bending device can be operated so that the ram presses the workpiece against fixed surfaces of the anvil or by control of the advance of the ram so that the deformation exceeds the elastic limit but is less than that which causes the workpiece to come to rest against the aforementioned surfaces of the anvil. In the latter case, a controller can be provided for the stroke of the ram.

According to the invention, the bending die comprises a saddle-shaped ram or bending saddle adapted to engage the workpiece from above at the two aforementioned locations equidistant from the center of the section of the workpiece to be bent and from the center of the bending anvil forming the bending die portion underlying the workpiece.

The anvil can comprise a pair of bending bars or checks which, in a cross-section taken in a plane perpendicular to the access of the circular segment into which the workpiece is to be bent, has a pair of inwardly inclined support surfaces so inclined as to be tangential to the curvature of the bent section.

The bending saddle, moreover, between the bearing locations can have a horizontal surface or can be set back (i.e. concave in the direction of the workpiece), while outwardly of the bearing locations, the bending saddle can be rounded, preferably with a radius of curvature substantially less than that imparted to each section of the workpiece by the bending operation.

According to yet another feature of the invention, this curvature of the bending saddle outwardly increases while the bending checks or bars have horizontal surfaces which meet the inclined surfaces at rounded edges.

The method and apparatus of the present invention have some significant advantages over the prior art systems.

Firstly, it allows each bending section of the workpiece, when a number of such sections are formed with incremental advance of the workpiece, to have a uniform curvature and hence it provides a uniform curvature for the finished body as well. This is in contrast with earlier systems in which more or less varying curvatures were formed during each incremental operation. The system of the present invention provides contact between the bending saddle and the workpiece at two spaced-apart locations rather than the singular location at the center of the bending ram of the earlier system and this, it is believed, accounts for the far more uniform bend imparted to the workpiece.

It should be understood that each support or bending location generally corresponds to a line of contact between the anvil or the bending saddle and the workpiece, especially since cylindrical bodies are preferably produced in accordance with the invention.

Thus, each of the bending bars or checke can be elongated so that the contact region between each bar and the workpiece lies along a line. The bending saddle is correspondingly elongated so that the bearing locations also are lines.

At the support and bearing locations, the forces act in the vertical direction and result in the aforementioned uniform bending action between the two bearing locations, i.e. over the entire length of the increment by which the workpiece is advanced. The resulting curvature thus closely approximates a circle segment and it has been found that the number of increments required for bending a given span of workpieces can be markedly reduced by comparison with earlier systems so that the number of operating steps and the time required to bend a circular segmental product is reduced as well. The result is high productivity of products within narrow tolerances and with a considerable saving of time and cost.

The rounding of the outer portions of the bending saddle, i.e. the portions outwardly of the bearing locations, with increasing radius of curvature from the exterior inwardly, local deformations which may mar the workpiece in the region of the bearing surfaces can be excluded.

The use of planar inwardly inclined surfaces of the anvil to provide support locations allow the curvature to vary linearly with the depth of penetration of the bending saddle into the anvil.

BRIEF DESCRIPTION OF THE DRAWING

The above and other objects, features and advantages of the present invention will become more readily apparent from the following description, reference being made to the accompanying drawing, in which.

SPECIFIC DESCRIPTION

The method of the present invention is intended to impart a substantially circular bend to a steel plate or sheet 1 in a plurality of successive bending operations with incremental advance of the originally flat workpiece 1 between the bending saddle 3 and the bending checks 2 of a bending die.

Figure 4:
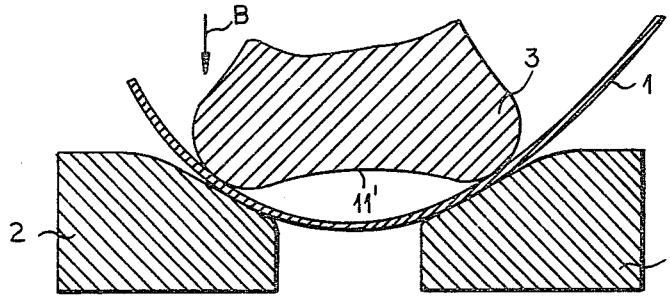
FIGS. 4–7 are cross-sectional views similar to FIG. 3 illustrating a succession of steps in the bending of a semi-cylindrical article in accordance with this invention.
Figure 5:
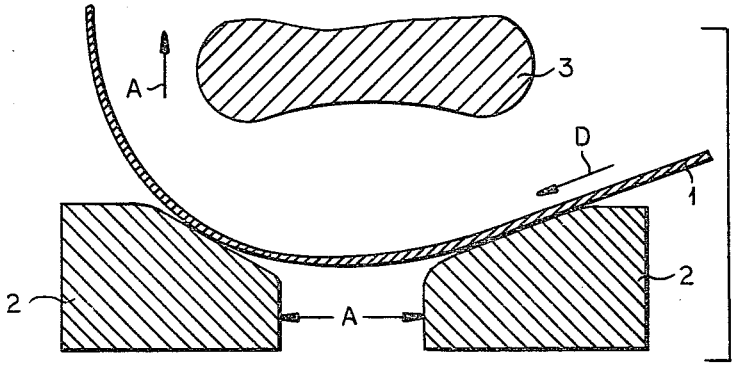

The bending saddle 3 is vertically reciprocated (arrows A and B in FIGS. 4 and 5), the latter being the working stroke and the former being a retraction stroke to enable the advance of the workpiece by an increment of displacement as represented by the arrow D in FIG. 5.

Figure 1:
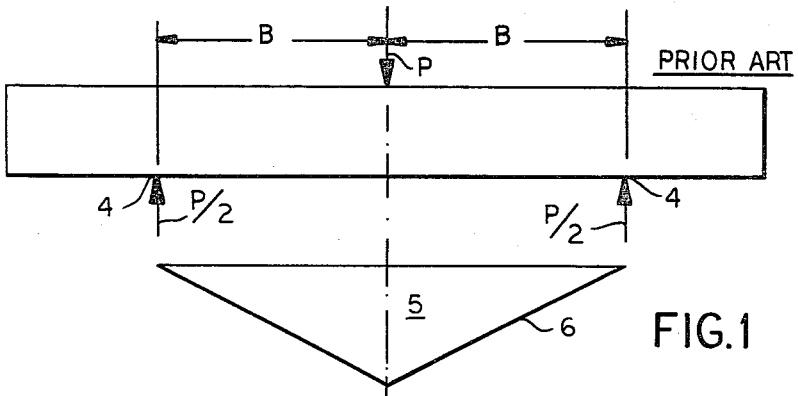
FIG. 1 is a force and moment diagram illustrating the bending operation for a prior art technique.

From the moment diagram of FIG. 1, it will be apparent that in prior art systems, the bending ram applied a force P at the center M of the section to be bent between two support locations 4 equally spaced at distances B from the central force-application location.

Because the bending force P was applied centrally, the moment surface 5 generated possessed the inclined flanks 6 corresponding to the moment lines, i.e. the moment increased toward the center M and thus a correspondingly nonuniform bend with greatest curvature at the location of force-application P was generated.

Figure 2:
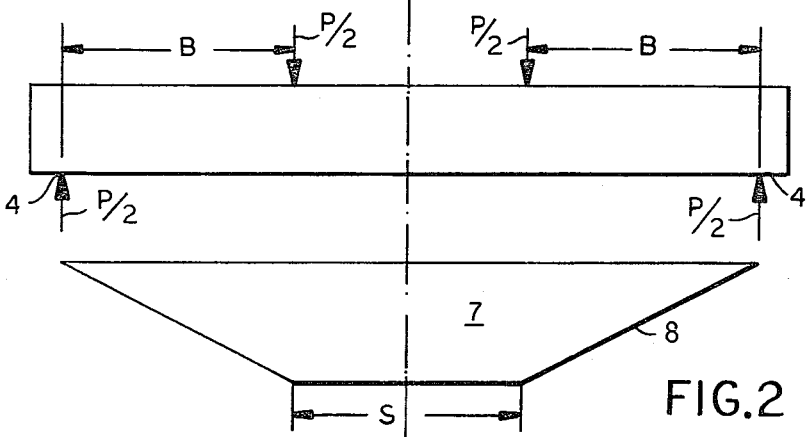
FIG. 2 is a diagram similar to FIG. 1 but illustrating the forces and moments which apply for a bending operation in accordance with the invention.

With the system of FIG. 2, corresponding to the system of the present invention, the force is applied at two locations spaced inwardly at distances B from the support location 4 but disposed to opposite sides of the center M, i.e. spaced by the distance S/2 from the center. At each of these force locations, the bending saddle 3 applies forces P/2 to the workpiece 1.

The result is the moment diagram 7 of FIG. 2 with the shallower flanks 8 terminating at a horizontal section at which a constant moment is generated over an increment S of length of the workpiece.

Thus, in the system of the invention, the bearing locations each apply a bending force P/2 and these bending forces are applied equidistantly from the center M between the two bending checks 2 of the die and at locations spaced at distances B from the support locations at which the bending checks act upon the workpiece. The result is application of force at two line contact locations separated by a distance S and spanning a region of constant bending moment. Because the bending moment in this region is constant, the curvature over the span S is extremely uniform.

For each operating step, the workpiece is advanced by a distance which is smaller than the distance between the support locations 4 and preferably corresponds to the length S.

Figure 3:
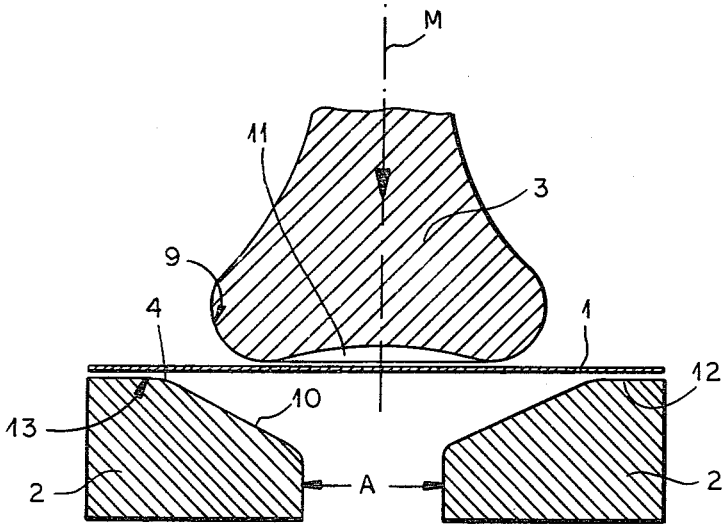
FIG. 3 is a vertical section illustrating a bending die arrangement according to the invention.

As can be seen from FIG. 3, the bearing locations of the bending saddle 3 can be bridged by a horizontal portion 11. Alternatively (see dot-dash lines in FIG. 3 and FIGS. 4–7), the region 11' between the bearing locations can be set back, i.e. concave toward the workpiece.

The bending saddle 3 is rounded outwardly of the bearing locations without outwardly increasing curvature.

In the transition region between the planar flanks 10, which are inclined inwardly so as to be tangential to the curved workpiece (see FIG. 7), and the horizontal surfaces 12 upon which the workpiece originally rests, the edges are rounded as shown at 13.

When the workpiece is inserted into the die (FIG. 3) it originally rests upon the surfaces 12 and the bending saddle 3 is then forced downwardly to plastically deform the workpiece (see FIG. 4). In the region between the bearing locations, this curvature is extremely uniform and, upon retraction of the bending saddle 3 (FIG. 5) the workpiece 1 is advanced by the distance S and the process is repeated (FIG. 4) assuring another increment with the same uniform bending moment.

Figure 7:
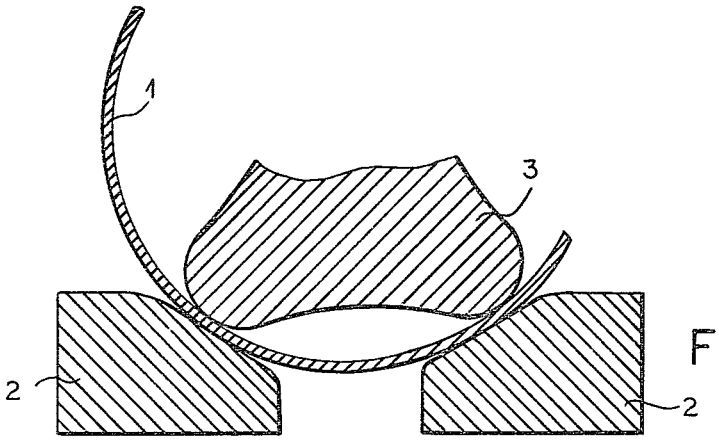

The process can be continued until a semicylindrical body is formed (FIG. 7).

Figure 6:
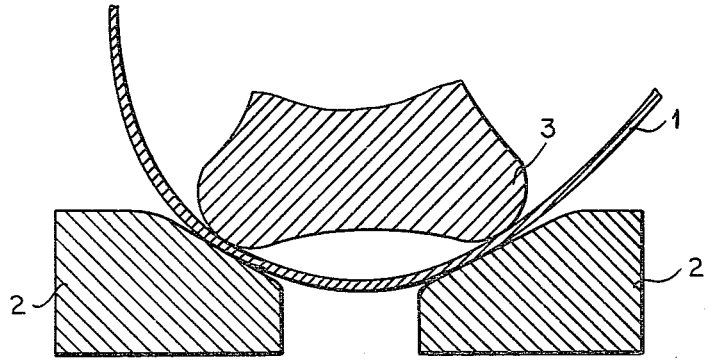

Although in FIGS. 4, 6 and 7, the final position of the bending saddle 3 clamps the workpiece against the surfaces 10 of the bending checks 2 of the anvil, it will be understood that larger radiuses of curvature for the resulting body can be obtained if the stroke of the bending saddle is limited so that the latter presses only partly into the anvil.

I claim:

1. A method of bending flat metal stock, comprising the steps of:

(a) supporting a portion of a workpiece formed from said stock at two spaced-apart support locations on one surface of said workpiece and disposed to opposite sides of a center;

(b) applying a bending force to the other surface of said workpiece at two bearing locations spaced to opposite sides of said center and spaced inwardly from the support locations at which said workpiece is supported, thereby plastically deforming said workpiece and imparting a uniform bend to a section of said workpiece in the region between said bearing locations;

(c) relieving said bending force and advancing said workpiece so as to dispose an adjacent section between said support locations; and (d) repeating steps (a) to (c) in succession until a predetermined curvature is imparted to said workpiece by the bending of successive sections thereof.

2. The method defined in claim 1 wherein the workpiece is advanced in step (c) and in repetitions thereof by a distance less than the distance between said support locations in the direction of advance of the workpiece.

3. The method defined in claim 2 wherein said workpiece is advanced in step (c) and in repetitions thereof by a distance equal substantially to the distance between said bearing locations.

4. The method defined in claim 1, claim 2 or claim 3 wherein the distance between each bearing location on one side of said center and the support location on the same side thereof is substantially one tenth to one quarter of the distance between said support locations.

* * * * *